US007543662B2

(12) United States Patent
Belnap et al.

(10) Patent No.: US 7,543,662 B2
(45) Date of Patent: Jun. 9, 2009

(54) STRESS-RELIEVED DIAMOND INSERTS

(75) Inventors: J. Daniel Belnap, Pleasant Grove, UT (US); Lynn Belnap, American Fork, UT (US); Christopher A. Tucker, Provo, UT (US)

(73) Assignee: Smith International, Inc., Houston, TX (US)

( * ) Notice: Subject to any disclaimer, the term of this patent is extended or adjusted under 35 U.S.C. 154(b) by 122 days.

(21) Appl. No.: 11/349,319

(22) Filed: Feb. 7, 2006

(65) Prior Publication Data

US 2006/0180354 A1 Aug. 17, 2006

Related U.S. Application Data

(60) Provisional application No. 60/653,256, filed on Feb. 15, 2005.

(51) Int. Cl.
*E21B 10/56* (2006.01)

(52) U.S. Cl. ..... 175/426; 175/434; 76/108.1

(58) Field of Classification Search ..... 175/426, 175/425, 434, 374; 76/108.1, 108.2, 108.4
See application file for complete search history.

(56) References Cited

U.S. PATENT DOCUMENTS

| | | | | |
|---|---|---|---|---|
| 2,941,241 | A | | 6/1960 | Strong |
| 2,941,248 | A | | 6/1960 | Hall |
| 2,947,611 | A | | 8/1960 | Bundy |
| 3,609,818 | A | | 10/1971 | Wentorf, Jr. |
| 3,767,371 | A | | 10/1973 | Wentorf, Jr. et al. |
| 4,289,503 | A | | 9/1981 | Corrigan |
| 4,525,178 | A | | 6/1985 | Hall |
| 4,673,414 | A | | 6/1987 | Lavens et al. |
| 4,694,918 | A | | 9/1987 | Hall |
| 4,954,139 | A | | 9/1990 | Cerutti |
| 5,304,342 | A | * | 4/1994 | Hall et al. ..... 419/11 |
| 5,370,195 | A | | 12/1994 | Keshavan et al. |
| 5,510,193 | A | * | 4/1996 | Cerutti et al. ..... 428/552 |
| 5,871,060 | A | | 2/1999 | Jensen et al. |
| 6,199,645 | B1 | * | 3/2001 | Anderson et al. ..... 175/426 |
| 6,220,357 | B1 | | 4/2001 | Carmichael et al. |
| 6,220,375 | B1 | | 4/2001 | Butcher et al. |
| 6,517,902 | B2 | * | 2/2003 | Drake et al. ..... 427/249.8 |
| 6,521,174 | B1 | | 2/2003 | Butcher et al. |
| 6,651,757 | B2 | | 11/2003 | Belnap et al. |
| 2001/0049019 | A1 | | 12/2001 | Drake et al. |

OTHER PUBLICATIONS

Combined Search and Examination Report issued in Application No. GB0603068.8 dated Jun. 14, 2006 (5 pages).

* cited by examiner

*Primary Examiner*—Kenneth Thompson
(74) *Attorney, Agent, or Firm*—Osha • Liang LLP

(57) ABSTRACT

A drill bit including at least one stress-relieved cutting element, wherein the at least one cutting element is mounted on the drill bit, wherein the stress-relieved cutting element includes a substrate, at least one transition layer disposed upon the substrate and a polycrystalline diamond layer having a thickness of at least 0.008 inches disposed upon the at least one transition layer.

20 Claims, 4 Drawing Sheets

STRESS-RELIEVED DIAMOND INSERTS

CROSS-REFERENCE TO RELATED APPLICATIONS

This application claims priority, pursuant to §119(e), of U.S. Provisional Ser. No. 60/653,256 filed on Feb. 15, 2005, which is herein incorporated by reference in its entirety.

BACKGROUND OF INVENTION

1. Field of the Invention

The invention relates generally to cutting elements used on rock bits such as roller cone rock bits, hammer bits, and drag bits. More specifically, the invention relates to drill bits having polycrystalline diamond enhanced cutting elements.

2. Background Art

Roller cone rock bits include a bit body adapted to be coupled to a rotatable drill string and include at least one "cone" that is rotatably mounted to the bit body. Referring to FIG. 1, a roller cone rock bit 10 is shown disposed in a borehole 11. The bit 10 has a body 12 with legs 13 extending generally downward, and a threaded pin end 14 opposite thereto for attachment to a drill string (not shown). Journal shafts 15 are cantilevered from legs 13. Rolling cutters (or roller cones) 16 are rotatably mounted on journal shafts 15. Each roller cone 16 has a plurality of cutting elements 17 mounted thereon. As the body 10 is rotated by rotation of the drill string (not shown), the roller cones 16 rotate over the borehole bottom 18 and maintain the gage of the borehole by rotating against a portion of the borehole sidewall 19. As the roller cone 16 rotates, individual cutting elements 17 are rotated into contact with the formation and then out of contact with the formation.

Hammer bits typically are impacted by a percussion hammer while being rotated against the earth formation being drilled. Referring to FIG. 2, a hammer bit is shown. The hammer bit 20 has a body 22 with a head 24 at one end thereof. The body 22 is received in a hammer (not shown), and the hammer moves the head 24 against the formation to fracture the formation. Cutting elements 26 are mounted in the head 24. Typically the cutting elements 26 are embedded in the drill bit by press fitting or brazing into the bit.

Drag bits are a type of rotary drill bits having no moving parts on them. Referring to FIG. 3, a drag bit is shown. The drag bit 30 has a bit body 32 with a plurality of blades 34 extending from the central longitudinal axis of rotation of the drill bit 36. A plurality of cutting elements 38 are secured on the blades.

Polycrystalline diamond ("PCD") enhanced inserts and tungsten carbide inserts are two commonly used cutting elements for roller cone rock bits, hammer bits, and drag bits.

Most cutting elements include a substrate of tungsten carbide (WC) based material, which consists of hard particulates of WC, interspersed with a binder component, preferably cobalt, which binds the tungsten carbide particles together. When used in drilling earth formations, the primary contact between the tungsten carbide cutting element and the earth formation being drilled is the outer end of the cutting element. Tungsten carbide cutting elements tend to fail by excessive wear because of their relative softness in comparison to ultrahard materials such as diamond. Thus, it is beneficial to offer this region of the cutting element greater wear protection.

An outer layer that includes diamond particles, such as a polycrystalline diamond (PCD), can provide such improved wear resistance, as compared to the softer tungsten carbide inserts. Such a polycrystalline diamond layer typically includes diamond particles held together by intergranular diamond bonds, which is accomplished by sintering diamond particles together under high pressure/high temperature (HP/HT) conditions in the presence of a diamond solvent catalyst such as cobalt. The attachment of the polycrystalline diamond layer to the tungsten carbide substrate is accomplished simultaneously with the sintering of the PCD material by placing diamond powder adjacent to a WC—Co substrate, and subjecting the diamond powder and the substrate to HP/HT conditions.

The HP/HT conditions used to manufacture the cutting elements result in dissimilar materials being bonded to each other. Because of the different thermal expansion rates between the diamond layer and the carbide, thermal residual stresses are induced on the diamond and substrate layers, and at the interface therebetween after cooling. The residual stress induced on the diamond layer and substrate can often result in insert breakage or delamination under drilling conditions.

To minimize these deleterious effects, the thickness of the polycrystalline diamond layer should be kept at minimum. In prior art cutting elements, the thickness of a polycrystalline diamond layer is typically in the range of 0.006 to 0.010 inches to reduce residual stresses. In fact, the paper "An Analytical Study of the Effects of Multiple Thin Polycrystalline Diamond Coatings on the Enhanced Insert" by Steven W. Peterson (Masters Thesis, Brigham Young University 1995) recommends a maximum polycrystalline diamond layer thickness of 0.008 inches, which was optimized by a finite element analysis-based residual stress study. Increasing the PCD thickness beyond 0.008 inch on enhanced insert products containing transition layers was not recommended because of increased residual stresses. However, this study examined only effects of changes to the design of the PCD and transition layers to lower residual stress, it did not consider the effects of processing.

Various prior art systems have attempted to reduce or remove some of the residual stresses in the cutting element so to avoid bit failure. For example, U.S. Pat. No. 4,694,918 utilizes an outer layer containing polycrystalline diamond with a preferred maximum thickness of approximately 0.005 inches, in conjunction with a transition layer.

Another prior art system, such as that of U.S. Pat. No. 6,199,645, utilizes a polycrystalline diamond layer having a maximum thickness in the critical zone situated between 20 and 80 degrees from the apex of the insert so as to reduce crack propagation due to thermal residual stress. A typical polycrystalline diamond layer maximum thickness of a '645 insert ranges from 0.012 to 0.026 inches.

To reduce residual stresses in inserts that include a polycrystalline diamond layer thickness of greater than 0.030 inches, U.S. Pat. No. 6,651,757 discloses modifying the material properties of the insert such that the polycrystalline diamond has a hardness reduced to between 2000 and 3000 Vickers Hardness Units.

Another known method of reducing residual stress is disclosed in U.S. Pat. No. 5,871,060. The '060 patent discloses the use of textured interfaces to act as a region of intermediate composition between the polycrystalline diamond layer and the carbide substrate.

While these prior art methods are capable of providing PCD cutting elements with improved properties, there exists a need for methods that can provide thicker polycrystalline diamond layers while managing the levels of thermal residual stress.

SUMMARY OF INVENTION

In one aspect, the present invention relates to a drill bit that includes a stress-relieved cutting element mounted on the drill bit, wherein the stress-relieved cutting element includes a substrate, at least one transition layer disposed on the substrate, and a polycrystalline diamond layer having a maximum thickness of 0.008 inches or higher disposed on the at least one transition layer.

In another aspect, the present invention relates to a cutting element that includes a substrate, at least one transition layer disposed on the substrate, and a polycrystalline diamond layer having a thickness of at least 0.008 inches disposed on the at least one transition layer, where the cutting element has a compressive residual stress less than 500 MPa.

In yet another aspect, the present invention relates to a method for forming a cutting element having reduced residual stress that includes the steps of forming a cutting element, and subjecting the cutting element to an heat treatment process, wherein the cutting element includes a substrate, at least one transition layer disposed on the stress-relieved substrate, and a polycrystalline diamond layer having a thickness of at least 0.020 inches disposed on the at least one transition layer.

Other aspects and advantages of the invention will be apparent from the following description and the appended claims.

DETAILED DESCRIPTION

In one aspect, embodiments of the invention relate to a cutting element having a polycrystalline diamond layer. In particular, embodiments of the invention relate to a cutting element having reduced residual stress for use in rock bits, hammer bits, or drag bits. Moreover, the invention relates to a method for forming such cutting elements.

As used herein, the term polycrystalline diamond, along with the abbreviation "PCD," refers to the material produced by subjecting individual diamond crystals to sufficiently high pressure and high temperatures that intercrystalline bonding occurs between adjacent diamond crystals. An exemplary minimum temperature is about 1200° C. and an exemplary minimum pressure is about 35 kilobars. Typical processing is at a pressure of about 45-55 kbar and 1300-1400° C. The minimum sufficient temperature and pressure in a given embodiment may depend on other parameters such as the presence of a catalytic material, such as cobalt. Generally, a catalyst or binder material is used to promote intercrystalline bonding. Those of ordinary skill will appreciate that a variety of temperatures and pressures may be used, and the scope of the present invention is not limited to specifically referenced temperatures and pressures.

Figure 1:
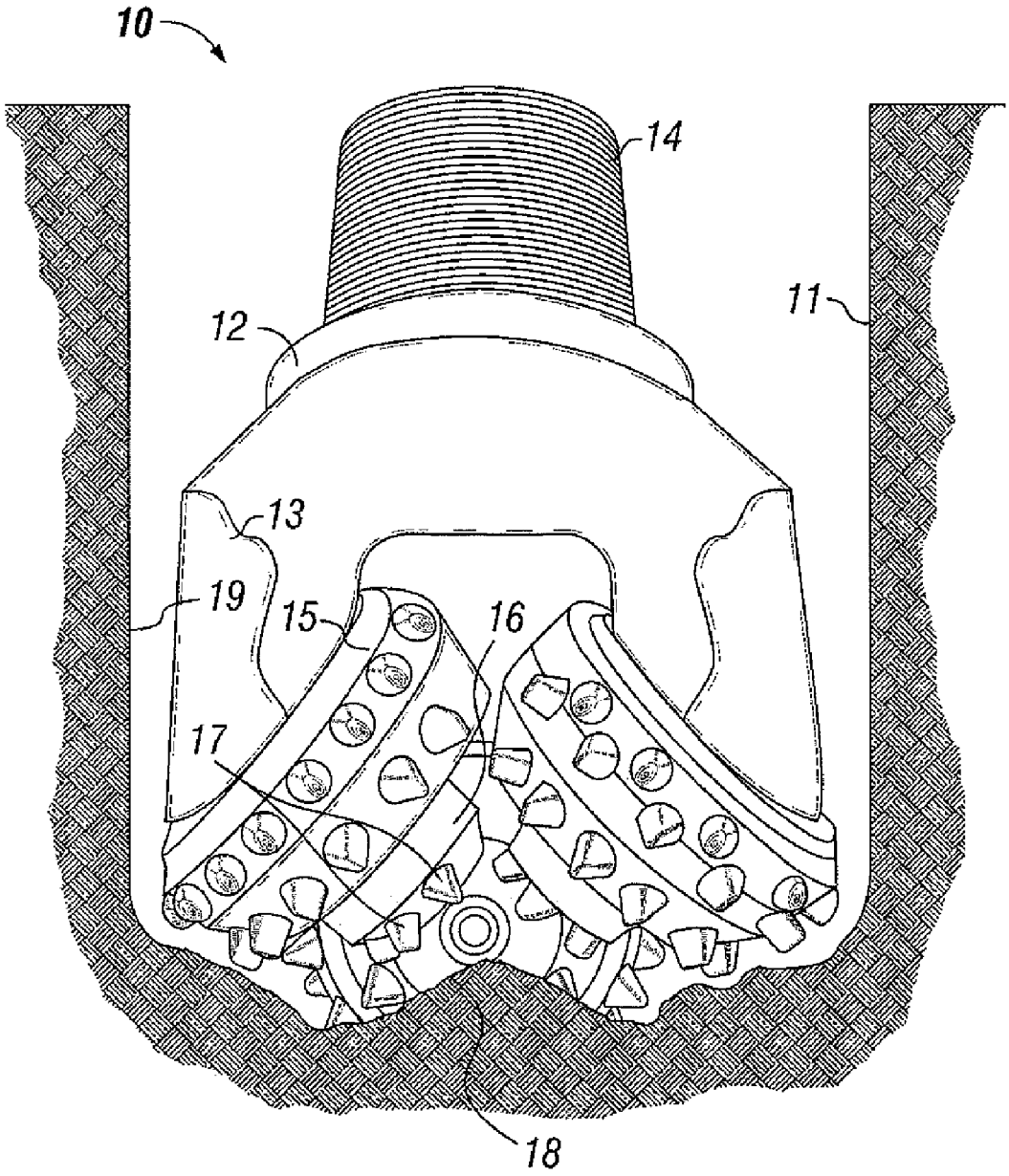
FIG. 1 is a side view of a roller cone rock bit.
Figure 2:
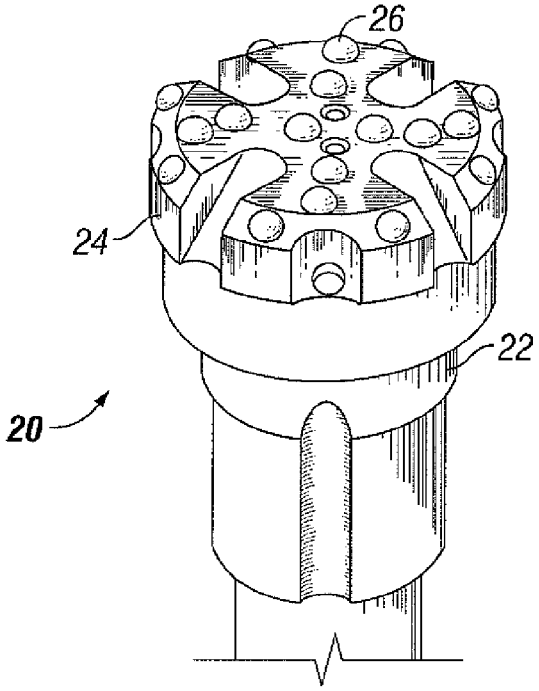
FIG. 2 is a side view of a hammer bit.
Figure 3:
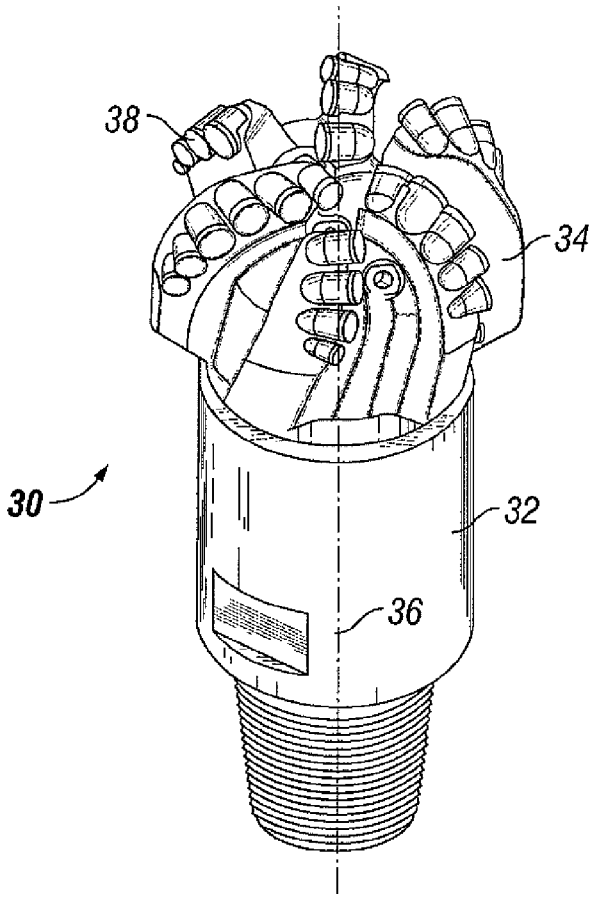
FIG. 3 is a side view of a drag bit.
Figure 4:
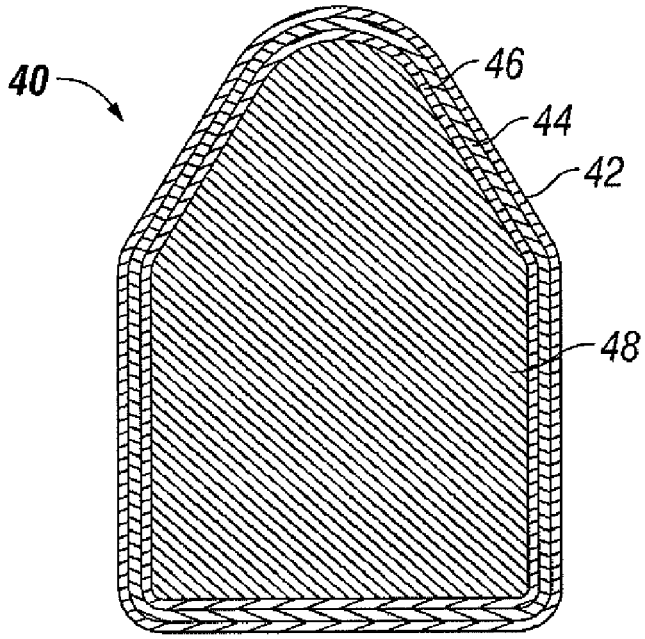
FIG. 4 shows an illustration of one embodiment of a cutting element in accordance with the present invention.

Referring to FIG. 4, a novel cutting element in accordance with an embodiment of the invention is shown. In this embodiment, as shown in FIG. 4, a stress-relieved cutting element 40 includes a polycrystalline diamond layer 42 for contacting the earth formation. Under the polycrystalline diamond layer 42, two transition layers, an outer transition layer 44 and an inner transition layer 46, are disposed between the polycrystalline diamond layer 42 and a substrate 48. While two transitions layers are shown in FIG. 4, some embodiments may include only one transition layer, and some embodiments may have more than two transition layers. In one embodiment, the polycrystalline diamond layer 42 has a thickness of at least 0.008 inches. In another embodiment, the polycrystalline diamond layer has a thickness of at least 0.016 inches. In other embodiments, the polycrystalline diamond layer has a thickness of at least 0.020 inches or at least 0.024 inches, respectively. As used herein, the thickness of any polycrystalline diamond layer refers to the maximum thickness of that layer. Specifically, as shown in U.S. Pat. No. 6,199,645, which is herein incorporated by reference in its entirety, the thickness of a polycrystalline diamond layer may vary so that the thickness is greatest within the critical zone of the cutting element. It is expressly within the scope of the present invention that a polycrystalline diamond layer may vary or taper such that it has a non-uniform thickness across the entire layer.

The stress-relieved cutting element 40 has a reduced compressive residual stress as compared to a cutting element that has not been stress-relieved. A cutting element that has not been subjected to a heat treatment process typically has a compressive residual stress of greater than 600 MPa. According to one embodiment of the present invention, the stress-relieved cutting element has a compressive residual stress of less 500 MPa. According to another embodiment of the present invention, the stress-relieved cutting element has a compressive residual stress of less than 200 MPa.

The substrate 48 may be formed from a suitable material such as tungsten carbide, tantalum carbide, or titanium carbide. Additionally, various binding metals may be included in the substrate, such as cobalt, nickel, iron, metal alloys, or mixtures thereof. In the substrate 48, the metal carbide grains are supported within the metallic binder, such as cobalt. Additionally, the substrate may be formed of a sintered tungsten carbide composite structure. It is well known that various metal carbide compositions and binders may be used, in addition to tungsten carbide and cobalt. Thus, references to the use of tungsten carbide and cobalt are for illustrative purposes only, and no limitation on the type substrate or binder used is intended.

In accordance with some embodiments of the invention, the stress-relieved cutting element may be formed by subjecting the cutting element to an process following formation of the cutting element. During the formation of the cutting element, internal thermal residual stress is induced when a significant temperature differential occurs, such as the rapid heating and cooling present in fabrication of the cutting element, and is influenced by differing thermal expansion coefficients of the juxtaposed layers.

The present inventors have discovered that a heat treatment cycle reduces or prevents the permanency of thermal residual stress in the cutting element. In a typical embodiment, the heat treatment cycle comprises of a heating phase, a holding phase, and a cooling phase and slowly heats and cools the cutting element so as to prevent the permanency of residual stress in the cutting element. The heat treatment process effectively removes the residual stress induced in the fabrication process which are present in the substrate, transition layers and polycrystalline diamond layers, and the interfaces therebetween. The removal of the residual stress from the layers of the cutting element may be achieved by placing the sintered cutting element in a vacuum furnace and subjecting it to temperatures of at least 500° C. for at least 2 hours. In a preferred embodiment, the heat treatment process may occur at a temperature of 620° C. for 2 hours in a vacuum furnace. Furthermore, the heat up to and cool down from the heat treatment temperature may be controlled over a period of at least 2 hours to promote even heating and cooling and greater removal of residual stress. Alternatively, the heat treatment process may occur simultaneously with the fabrication of the cutting element so as to prevent the induction of the residual stress. Those having ordinary skill in the art will appreciate that a number of different temperatures and times may be used to achieve the intended result and no limitation on the scope of the present invention is intended by specific references thereto.

Figure 5:
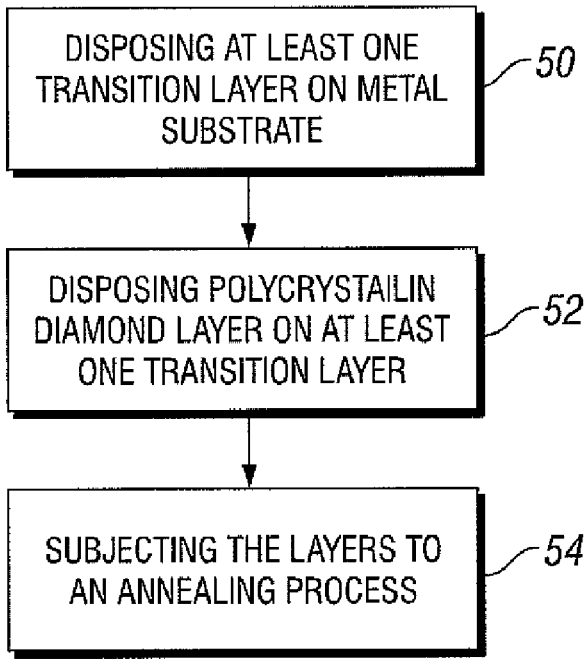
FIG. 5 shows a flowchart of one embodiment of the invention for forming a cutting element having reduced residual stress.

A cutting element made according to some embodiments of the invention is described in FIG. 5. As shown in FIG. 5, at least one transition layer is disposed on a substrate (step 50). A polycrystalline diamond layer is disposed on the at least one transition layer (step 52). The substrate, at least one transition layer and polycrystalline diamond layer are then subjected to a heat treatment process (step 54), which follows the HP/HT sintering process in which the PCD layer and the at least one transition layer are consolidated and joined to the substrate.

According to one embodiment of the present invention, a drill bit, such as a roller cone bit, hammer bit, or drag bit, includes at least one stress-relieved cutting element having a substrate, at least one transition layer, and a polycrystalline diamond layer. In another embodiment of the invention, a drill bit may also include at least one non-stress-relieved cutting element.

In accordance with some embodiments, at least one stress-relieved cutting element on a drill bit has a PCD thickness of at least 0.008 inches. In accordance with other embodiments at least one stress-relieved cutting element on the drill bit has a PCD thickness of at least 0.016 inches. In accordance with other embodiments, at least one stress-relieved cutting element on a drill bit has a PCD thickness of at least 0.024 inches. In yet other embodiments, a drill bit may also have at least one cutting element having a PCD thickness of up to 0.008 inches or more.

In accordance with some embodiments of the invention, the at least one transition layer may include composites of diamond crystals, cobalt, and particles of a metal carbide or metal carbonitride, such as the carbide or carbonitride of W, Ta, Ti or mixtures thereof. Tungsten carbide may be cemented carbide, stoichiometric tungsten carbide, cast tungsten carbide, or a plasma sprayed alloy of tungsten carbide and cobalt. It is well known that various metal carbide or carbonitride compositions and binders may be used, in addition to tungsten carbide and cobalt. Thus, references to the use of tungsten carbide and cobalt are for illustrative purposes only, and no limitation on the type metal carbide or carbonitride or binder used is intended.

In accordance with some embodiments of the invention, the particle size of the carbide may be less than the particle size of the diamond crystals in the transition layer. The at least one transition layer may be formed in a conventional manner. One example of such process can be found in U.S. Pat. No. 4,694,918. Briefly, diamond crystals and cobalt are ball milled together and are then ball milled with the addition of tungsten carbide. The composite for each transition layer is made separately, with slight variations in the relative proportions of the composite materials.

When multiple transition layers are present, the transition layer near the polycrystalline diamond layer may contain a greater proportion of diamond crystals, while the transition layer near the substrate may contain a greater proportion of tungsten carbide. The cutting element may include any number of transition layers. More than one transition layer may create a gradient with respect to diamond content: the proportion of diamond content decreases between the transition layers, moving inwardly toward the substrate. Referring to FIG. 4, the outer transition layer 44 has a diamond content greater than the inner transition layer 46. Alternatively, the cutting element may include a single transition layer (not shown separately). The single transition layer may also include a gradient of diamond content with the region of the single transition layer near the polycrystalline diamond layer having a diamond content greater than that of the region of the single transition layer near the substrate. The gradient within the single transition layer, for example, may be generated by methods known in the art. An example of a transition having such gradient can be found in U.S. Pat. No. 4,694,918.

The at least one transition layer interposed between the polycrystalline diamond layer and the substrate may create a gradient with respect to the thermal expansion coefficients for the layers. The magnitude of residual stress at the interfaces depends on the disparity between the thermal expansion coefficients and elastic constants for the juxtaposed layers. The coefficient of thermal expansion for the substrate may be greater than the at least one transition layer, which may be greater than that of the polycrystalline diamond layer. Referring to FIG. 4, the coefficient of thermal expansion of the inner transition layer 46 may be greater than that of the outer transition layer 44.

The presence of at least one transition layer between the polycrystalline diamond layer and the substrate also creates a gradient with respect to elasticity and minimizes a sharp drop in elasticity between the polycrystalline diamond layer and the substrate that would otherwise contribute to chipping of the PCD layer from the cutting element. Because of the progressive decrease in diamond content and increase in carbide content, the modulus of elasticity progressively decreases from the PCD layer to the substrate. This can be accomplished through the use of discrete transition layers as in a previously described embodiment, the transition layer adjacent the outer layer having a higher proportion of diamond crystals than that of the transition layer adjacent the substrate, or by a gradient of diamond crystals and tungsten carbide within a single transition layer, with the proportion of diamond crystals decreasing towards the substrate.

The polycrystalline diamond layer may be formed from a composite including diamond crystals and a metal catalyst, such as cobalt. Alternatively, the polycrystalline diamond layer may be formed from a composite including diamond crystals, Group VIII metals such as cobalt, nickel, or iron, and particles of carbides or carbonitrides of the transition metals selected from the group consisting of W, Ti, Ta, Cr, Mo, Cb, V, Hf, Zr, and mixtures thereof.

The polycrystalline diamond layer includes individual diamond "crystals" that are interconnected. The individual diamond crystals thus form a lattice structure. A metal catalyst, such as cobalt, may be used to promote recrystallization of the diamond particles and formation of the lattice structure. Thus, cobalt particles are typically found in the interstitial spaces in the diamond lattice structure.

In another embodiment, the polycrystalline diamond layer may also include thermally stable polycrystalline diamond (also known as TSP). The manufacture of TSP is known in the art, but a brief description of the process is described herein. As mentioned, when formed, a polycrystalline diamond layer comprises a diamond lattice structure with cobalt particles often being found within the interstitial spaces in the diamond lattice structure. Cobalt has a significantly different coefficient of thermal expansion, as compared to diamond, so upon extreme heating of the diamond layer, the cobalt will expand, causing cracks to form in the lattice structure, resulting in deterioration of the diamond layer.

In order to obviate this problem, strong acids are used to "leach" the cobalt from the diamond lattice structure. Removing the cobalt causes the diamond layer to become more heat resistant, but also causes the diamond layer to become more brittle. Accordingly, in certain cases, only a select portion (measured in either depth or width) of a diamond layer is leached, in order to gain thermal stability without losing impact resistance. As used herein, the term TSP includes both of the above (i.e., partially and completely leached) compounds.

The polycrystalline diamond layer and the at least one transition layer maybe formed in a conventional manner, such as by a high pressure, high temperature sintering of "green" particles to create intercrystalline bonding between the particles. "Sintering" may involve a high pressure, high temperature (HPHT) process. Examples of high pressure, high temperature (HPHT) process can be found, for example, in U.S. Pat. Nos. 4,694,918; 5,370,195; and 4,525,178. Briefly, to form the polycrystalline diamond layer, an unsintered mass of diamond crystalline particles is placed within a metal enclosure of the reaction cell of a HPHT apparatus. A metal catalyst, such as cobalt, and tungsten carbide particles may be included with the unsintered mass of crystalline particles. The reaction cell is then placed under processing conditions sufficient to cause the intercrystalline bonding between the diamond particles. It should be noted that if too much additional non-diamond material, such as tungsten carbide or cobalt is present in the powdered mass of crystalline particles, appreciable intercrystalline bonding is prevented during the sintering process. Such a sintered material where appreciable intercrystalline bonding has not occurred is not within the definition of PCD. The transition layers may similarly be formed by placing an unsintered mass of the composite material containing diamond particles, tungsten carbide and cobalt within the HPHT apparatus. The reaction cell is then placed under processing conditions sufficient to cause sintering of the material to create the transition layer. Additionally, a preformed metal carbide substrate may be included. In which case, the processing conditions can join the sintered crystalline particles to the metal carbide substrate. Similarly, a substrate having one or more transition layers attached thereto may be used in the process to add another transition layer or a polycrystalline diamond layer. A suitable HPHT apparatus for this process is described in U.S. Pat. Nos. 2,947,611; 2,941,241; 2,941,248; 3,609,818; 3,767,371; 4,289,503; 4,673,414; and 4,954,139.

Application of the HPHT processing will cause diamond crystals to sinter and form a polycrystalline diamond layer. Similarly, application of HPHT to the composite material will cause the diamond crystals and carbide particles to sinter such that they are no longer in the form of discrete particles that can be separated from each other. Further, all of the layers bond to each other and to the substrate during the HPHT process.

EXAMPLE

Figure 6:
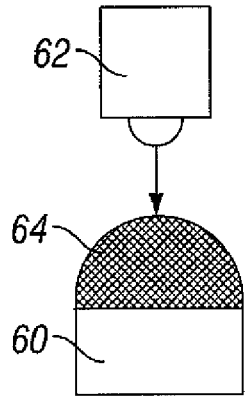
FIG. 6 is an illustration of a test configuration for the residual stress analysis.

One way to assess the residual stress of a cutting element is by utilizing Raman spectroscopy. A schematic of a configuration for such tests is shown in FIG. 6. Laser probe 62 is directed at the apex of the polycrystalline diamond dome 64 of cutting element 60. Diamond has a single Raman-active peak, which under stress free conditions is located at $\omega_0$=1332.5 $cm^{-1}$. For polycrystalline diamond, this peak is shifted with applied stress according to the relation:

$$\Delta\omega = \frac{\omega_0\gamma}{B}\sigma_H$$

where $\Delta\omega$ is the shift in the Raman frequency, $\gamma$ is the Grunesian constant, equaling 1.06, B is the bulk modulus, equaling 442 GPa, and $\sigma_H$ is the hydrostatic stress. $\sigma_H$ is defined as:

$$\sigma_H = \frac{\sigma_1 + \sigma_2 + \sigma_3}{3}$$

where $\sigma_1$, $\sigma_2$, and $\sigma_3$ are the three orthogonal stresses in an arbitrary coordinate system, the sum of which equals the first stress invariant. In the center of the apex of an insert, it is reasonable to assume equibiaxial conditions ($\sigma_1=\sigma_2=\sigma_B$ and $\sigma_3=0$). In which case, the relation between the biaxial stress $\sigma_B$ and the peak shift is given by:

$$\Delta\omega = \frac{2\omega_0\gamma}{3B}\sigma_B.$$

In an example of cutting elements made according to a method of the invention, a sample of six cutting elements were formed and subjected to a heat treatment process of 620° C. for 2 hours in a vacuum furnace. The cutting elements were characterized using Raman spectroscopy and fatigue contact testing.

The equipment used to collect the Raman spectra employed a near-infrared laser operating at 785 nm, a fiber optic lens/collection system, and a spectrometer incorporating a CCD-array camera. The peak centers are determined by fitting a Gaussian curve to the experimental data using intrinsic fitting software. The Gaussian expression is given by:

$$I(x) = I_0\exp\left[\ln 0.5\frac{(x-\omega_C)^2}{(w/2)^2}\right]$$

where I(x) is the intensity as a function of position, $I_0$ is the maximum intensity, $\omega_C$ is the peak center, and w is the peak width, i.e., the full width at half maximum intensity. In this analysis, the fitted peak center was used to determine the residual stress. To facilitate accurate estimation of the residual stress, unsintered PCD powder was used to obtain the stress-free reference (1332.5 $cm^{-1}$). To ensure that the heating effects sometimes observed in small grain size diamond powders do not interfere with the analysis, the unsintered PCD powder was placed as a thin layer on a copper heat sink. These results are illustrated in Table I.

Referring to Table I, the stress-relieved inserts showed a measured stress relief of approximately 550 MPa relative to the non-stress-relieved inserts. This represents an approximately 80% reduction in the residual stress on these inserts.

TABLE I

| Condition | Peak Center | Residual Stress | Samples |
|---|---|---|---|
| Non-stress-relieved | 1333.98 ± 0.26 cm | −695 ± 122 MPa | 18 |
| Stress-relieved | 1332.80 ± 0.36 cm | −142 ± 170 MPa | 18 |

Figure 7:
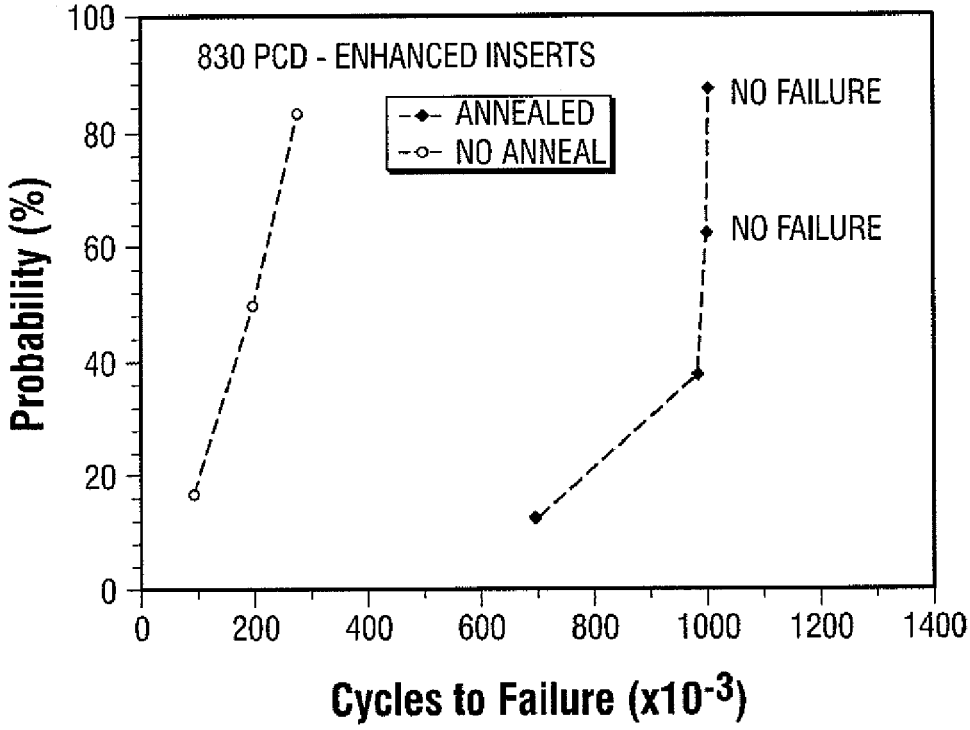
FIG. 7 is a graph illustrating the fatigue life analysis of the cutting element made in accordance with the present invention as compared to a convention cutting element.

The inserts were also subjected to fatigue contact testing using a compression-compression cyclic loading on a servo-hydraulic load frame under sinusoidal loading conditions between −1400 and −14,000 pounds. The results of the fatigue testing are shown in the Weibull plot in FIG. 7. Referring to FIG. 7, the non-stress-relieved inserts failed after an average of 191,000 cycles while the average of the stress-relieved inserts was at least 922,000 cycles. It should be noted that two of the stress-relieved samples did not fail under these loading conditions; therefore, the average for the stress-relieved inserts is an underestimate of the cycles to failure. Thus, the increase in fatigue life with heat treatment is at least a factor of 4.

Advantages of the embodiments of the invention may include one or more of the following. A stress-relieved cutting element having a polycrystalline diamond layer, at least one transition layer and a substrate would allow for a cutting element with reduced residual stress as compared to a cutting element that has not been stress-relieved. A cutting element according to one embodiment of the present invention may also demonstrate an increase in fatigue life. A cutting element having a conventional PCD layer (0.008 inches) may possess reduced residual stress. As the thickness of the PCD layer is increased in the cutting elements, these cutting elements that have been heat treated may have the dual advantage of possessing increased wear resistance for applications where abrasive wear is a limiting factor and also increased resistance to application-induced flexural cracking, provided the PCD residual stresses can be adequately controlled.

In certain embodiments, the polycrystalline diamond thickness may be about 0.008 inches. In other more preferred embodiments, the polycrystalline diamond layer thickness may be about 0.016 inches or greater. A further preferred embodiment has a polycrystalline diamond layer thickness of 0.024 inches or greater.

The gradient of thermal expansion coefficients between the substrate, the at least one transition layer, and the polycrystalline diamond layer may reduce residual stress in the cutting element and the incidents of delamination of the diamond layer by interposing a layer with a lower thermal expansion coefficient, as compared to the substrate, next to the diamond layer. The heat treatment processing performed on the cutting element further reduces the presence of residual stress, enhancing the life of the cutting elements on drill bits. The observed reduction in residual stress allows for thicker polycrystalline diamond layers with transition layers while managing thermal residual stress.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A drill bit comprising:

at least one stress-relieved cutting element, wherein the at least one stress-relieved cutting element is heat treated in a post-sintering heat treatment process to have a compressive residual stress less than 500 MPa, and wherein the at least one stress-relieved cutting element is mounted on the drill bit, the stress-relieved cutting element comprising:

a substrate;

at least one transition layer disposed upon the substrate, wherein the at least one transition layer comprises diamond particles and a metal carbide; and a polycrystalline diamond layer having a thickness of at least 0.008 inches disposed upon the at least one transition layer.

2. The drill bit of claim 1, wherein the polycrystalline diamond layer has a thickness of at least 0.016 inches.

3. The drill bit of claim 1, wherein the polycrystalline diamond layer has a thickness of at least 0.024 inches.

4. The drill bit of claim 3, wherein the at least one transition layer has a diamond content less than a diamond content of the polycrystalline diamond layer.

5. The drill bit of claim 1, wherein the at least one transition layer comprises at least an inner transition layer and an outer transition layer.

6. The drill bit of claim 4, wherein the outer transition layer has a diamond content less than a diamond content of the polycrystalline diamond compact layer.

7. The drill bit of claim 4, wherein the inner transition layer has a diamond content less than a diamond content of the outer transition layer.

8. The drill bit of claim 1, wherein the polycrystalline diamond layer comprises thermally stable polycrystalline diamond.

9. A cutting element for use in a drill bit, comprising:

a substrate;

at least one transition layer disposed upon the substrate; and a polycrystalline diamond layer having a thickness of at least 0.008 inches disposed upon the at least one transition layer, wherein the cutting element has a compressive residual stress less than 200 MPa; and wherein the polycrystalline diamond layer comprises thermally stable polycrystalline diamond.

10. The cutting element of claim 9, wherein the substrate comprises at least one carbide selected from tungsten carbide, tantalum carbide, and titanium carbide.

11. The cutting element of claim 9, wherein the polycrystalline diamond layer has a thickness of at least 0.016 inches.

12. The cutting element of claim 9, wherein the polycrystalline diamond layer has a maximum thickness of at least 0.024 inches.

13. The cutting element of claim 9, wherein the at least one transition layer comprises at least an inner transition layer and an outer transition layer.

14. The cutting element of claim 13, wherein the outer transition layer has a diamond content less than a diamond content of the polycrystalline diamond compact layer.

15. The cutting element of claim 13, wherein the inner transition layer has a diamond content less than a diamond content of the outer transition layer.

16. The drill bit of claim 9, wherein the at least one transition layer comprises diamond particles and a metal carbide.

17. A method for forming a cutting element having reduced residual stresses, comprising:

forming a cutting element; and subjecting the cutting element to a secondary heat treatment process to reduce the residual stresses in the cutting element comprising:

a heating phase controlled over a period of at least 2 hours; and a holding phase, performed at a temperature of at least 500° C, wherein the cutting element comprises a substrate, at least one transition layer disposed upon the substrate, and a polycrystalline diamond layer having a thickness of at least 0.008 inches disposed upon the at least one transition layer.

18. The method of claim 17, wherein the forming a cutting element comprises sintering the at least one transition layer to the substrate and sintering the polycrystalline diamond layer to the at least one transition layer.

19. The method of claim 18, wherein the sintering the polycrystalline diamond compact to the substrate and the subjecting the cutting element to a heat treatment process occur sequentially.

20. The method of claim 17, wherein the heat treatment process comprises a cooling phase, wherein the cooling phase is controlled over a period of at least 2 hours.

* * * * *